US008925561B2

(12) United States Patent
Welch

(10) Patent No.: US 8,925,561 B2
(45) Date of Patent: Jan. 6, 2015

(54) DISHWASHER DISPENSING SYSTEM WITH TIMED DELAY

(75) Inventor: Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 296 days.

(21) Appl. No.: 13/270,541

(22) Filed: Oct. 11, 2011

(65) Prior Publication Data

US 2013/0087173 A1 Apr. 11, 2013

(51) Int. Cl.

| | |
|---|---|
| ***B08B 3/00*** | (2006.01) |
| ***A47L 15/44*** | (2006.01) |
| *A47L 15/22* | (2006.01) |

(52) U.S. Cl.

CPC ..... *A47L 15/4445* (2013.01); *A47L 15/22* (2013.01)

USPC ..... 134/93

(58) Field of Classification Search

CPC .... A47L 15/44; A47L 15/4418; A47L 15/449

USPC ..... 134/56 D, 57 D, 58 D, 93, 99.2

See application file for complete search history.

(56) References Cited

U.S. PATENT DOCUMENTS

| | | | | |
|---|---|---|---|---|
| 2,127,778 | A | 8/1938 | Lewis | |
| 2,711,178 | A | 6/1955 | Sharp et al. | |
| 3,204,831 | A * | 9/1965 | Butler et al. | 222/630 |
| 3,207,373 | A | 9/1965 | Dannenmann | |
| 3,612,074 | A | 10/1971 | Dossey | |
| 3,828,975 | A * | 8/1974 | Robandt et al. | 222/651 |
| 5,235,994 | A | 8/1993 | Comin et al. | |
| 6,773,668 | B1 | 8/2004 | Everson et al. | |
| 7,445,013 | B2 | 11/2008 | VanderRoest et al. | |
| 7,475,696 | B2 | 1/2009 | Vanderroest et al. | |
| 7,749,335 | B2 | 7/2010 | Simmons et al. | |
| 7,832,417 | B2 | 11/2010 | Gunnerson et al. | |
| 7,914,625 | B2 | 3/2011 | Bertsch et al. | |
| 2006/0144424 | A1 | 7/2006 | Marchitto et al. | |
| 2007/0246077 | A1 | 10/2007 | Simmons et al. | |
| 2009/0101182 | A1 | 4/2009 | Buesing et al. | |
| 2009/0139553 | A1 * | 6/2009 | Park | 134/176 |
| 2010/0000585 | A1 | 1/2010 | Hartmann et al. | |
| 2010/0012158 | A1 | 1/2010 | Rosenbauer et al. | |
| 2010/0065091 | A1 | 3/2010 | Hartmann et al. | |
| 2011/0030742 | A1 | 2/2011 | Dalsing et al. | |

FOREIGN PATENT DOCUMENTS

| | | |
|---|---|---|
| EP | 1319360 A1 | 6/2003 |
| EP | 1882439 A1 | 1/2008 |
| GB | 1289412 | 9/1972 |
| GB | 2321590 A | 8/1998 |

(Continued)

*Primary Examiner* — David Cormier

(57) ABSTRACT

A dishwasher includes an auxiliary dispenser assembly used in conjunction with an auxiliary spray unit, preferably to create an intensified wash zone in the washing chamber. The dispenser assembly includes a container partitioned into a prefill chamber and an additive chamber. A washing fluid inlet leads into the prefill chamber, which is also provided with a calibrated drain hole. During at least one stage of a washing operation, a portion of the washing fluid delivered to the auxiliary spray unit is diverted and forced to flow into the prefill chamber, fill the prefill chamber, overflow into the additive chamber and exit the dispenser assembly with additional washing agent. During other stages or between stages, any washing fluid entering the inlet is directed out the drain hole so as to not reach the additive chamber.

20 Claims, 2 Drawing Sheets

(56) References Cited

FOREIGN PATENT DOCUMENTS

| | | | |
|---|---|---|---|
| JP | 8228989 | A | 9/1996 |
| WO | 02074153 | A1 | 9/2002 |
| WO | 2009083576 | A1 | 7/2009 |
| WO | 2009083577 | A1 | 7/2009 |
| WO | 2010007050 | A1 | 1/2010 |

* cited by examiner

DISHWASHER DISPENSING SYSTEM WITH TIMED DELAY

BACKGROUND OF THE INVENTION

1. Field of the Invention

The present invention pertains to the art of dishwashers and, more particularly, to the incorporation of a detergent dispensing system structured to establish a timed delay for the introduction of detergent during a washing operation.

2. Discussion of the Related Art

In a typical dishwasher, a detergent dispenser is provided in a washing chamber to house a detergent. The compartment is loaded with detergent and includes a cover which is initially, manually closed and then subsequently, automatically opened to dispense detergent directly into the washing chamber of the dishwasher during a predetermined stage of a washing operation. Many attempts have been made in the art of dishwashers to provide improved detergent dispersion and effectiveness. For instance, it is also known to direct a cleaning agent from a dispenser directly into a spray arm, such as demonstrated by UK Patent Application No. GB 2321590 and U.S. Pat. No. 5,235,994, or to impinge washing fluid from a rotating spray arm directly into an exposed dispenser container to slowly dissolve and distribute a cleaning agent, such as demonstrated by International Publication WO 2009/083576.

In connection with improving an overall washing operation, it is also known in the art to provide a variety of spray units for the washing fluid. That is, in addition to rotary arms, it is known to provide fixed spray heads. For instance, U.S. Pat. Nos. 7,445,013 and 7,475,696 are concerned with providing one or more additional spray units which can establish certain wash zones with a dishwasher. Even when all of the spray units are slated to be employed for a selected washing operation, the activation of the different ones or sets of the spray units are generally, sequentially timed for various reasons, such as to maintain sufficient water pressure.

It can also be desirable to incorporate an auxiliary dispenser to increase the concentration washing agent in order to enhance the performance of the dishwasher. In fact, this broad concept is disclosed in the '696 patent listed above. In general, with such known arrangements, whenever washing fluid is directed to a specified spray unit having an auxiliary dispenser, additional detergent from the dispenser is added to the washing fluid. Unfortunately, there may exist certain scenarios wherein washing fluid is slated to be directed to a particular spray unit multiple times during an overall washing operation and it is only desired to provide for the additional detergent dispensing during a single operational phase of the spray unit. With this in mind, despite various known prior art designs, there is still seen to be a need in the art of dishwashers for a dishwasher cleaning agent dispenser system configured to timely release detergent for a given washing operation. In particular, it is seen as beneficial to provide an auxiliary dispenser that can be easily accessed by a user and selectively utilized to aide in the cleaning of heavily soiled kitchenware by quickly and effectively distributing a chemical agent within an intensified wash zone in a timed manner during a washing operation in a dishwasher.

SUMMARY OF THE INVENTION

The present invention is directed to providing a dispensing system for introducing additional chemical washing agent into the tub of a dishwasher during select portions of a washing operation. The dishwasher includes a dish rack for supporting kitchenware, at least a first spray unit, such as a rotatable spray arm, for directing washing fluid onto the kitchenware, an auxiliary fluid distribution or second spray unit configured to create an intensified wash zone in the washing chamber during at least one stage of the washing operation, a main detergent dispenser, and an auxiliary dispenser assembly. The auxiliary dispenser assembly includes a dual chamber storage compartment having a first or prefill chamber with an associated inlet, and an additive chamber for housing a washing agent. A lid is provided to enable access to at least the additive chamber in order to selectively load the washing agent. The prefill chamber is separated from the additive chamber by a partition, while also including a calibrated drain hole. On the other hand, the additive chamber is provided with an associate outlet for the dispenser assembly.

With this arrangement, washing fluid directed into the dispenser assembly initially enters the prefill chamber. At the same time, washing fluid is allowed to exit the dispenser assembly from the calibrated drain hole. If the flow of washing fluid into the prefill chamber is low in duration and/or flow rate, the washing fluid will simply be caused to flow out the calibrated drain hole. However, if the flow of washing fluid into the prefill chamber is greater than a certain duration and/or flow rate, the washing fluid will be caused to overflow from the prefill chamber into the additive chamber, thereby picking up additional detergent. Thereafter, the washing fluid with the increased detergent concentration will be directed through the outlet and into the washing chamber.

In accordance with one embodiment of the invention, the auxiliary dispenser assembly is attached to the dish rack for movement with the dish rack into and out of the washing chamber of the dishwasher. When the dish rack is positioned in the recessed position, the inlet of the storage compartment is automatically arranged in fluid communication with the auxiliary fluid distribution or second spray unit, while the outlet of the auxiliary dispenser is directly exposed to the washing chamber. In another embodiment, the auxiliary dispenser is provided separate from the dish rack and fixed relative to the second spray unit. Regardless of the mounting of the dispenser assembly, a timed release of the detergent or other washing agent is assured since the washing fluid directed to the second spray unit will only pick up additional washing agent and deliver the same into the washing chamber for enhanced cleansing purposes after the washing fluid is supplied for a specified amount of time.

The use of the auxiliary dispenser is seen to be particularly advantageous in connection with washing kitchenware having tough soil thereon, such as soils that are baked on prior to the kitchenware being loaded into the rack, by providing a convenient way to establish a higher level of detergent concentration in the washing fluid directed onto the kitchenware during a predetermined portion of an overall washing cycle. That is, for certain washing operations, the washing fluid is sequentially delivered to various spray units through control of a diverter unit. If, in order to alter the flow between two spray units the washing fluid must temporarily flow to another spray unit provided with the auxiliary dispenser, the untimely dispensing of the washing agent from the auxiliary dispenser is avoided. Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
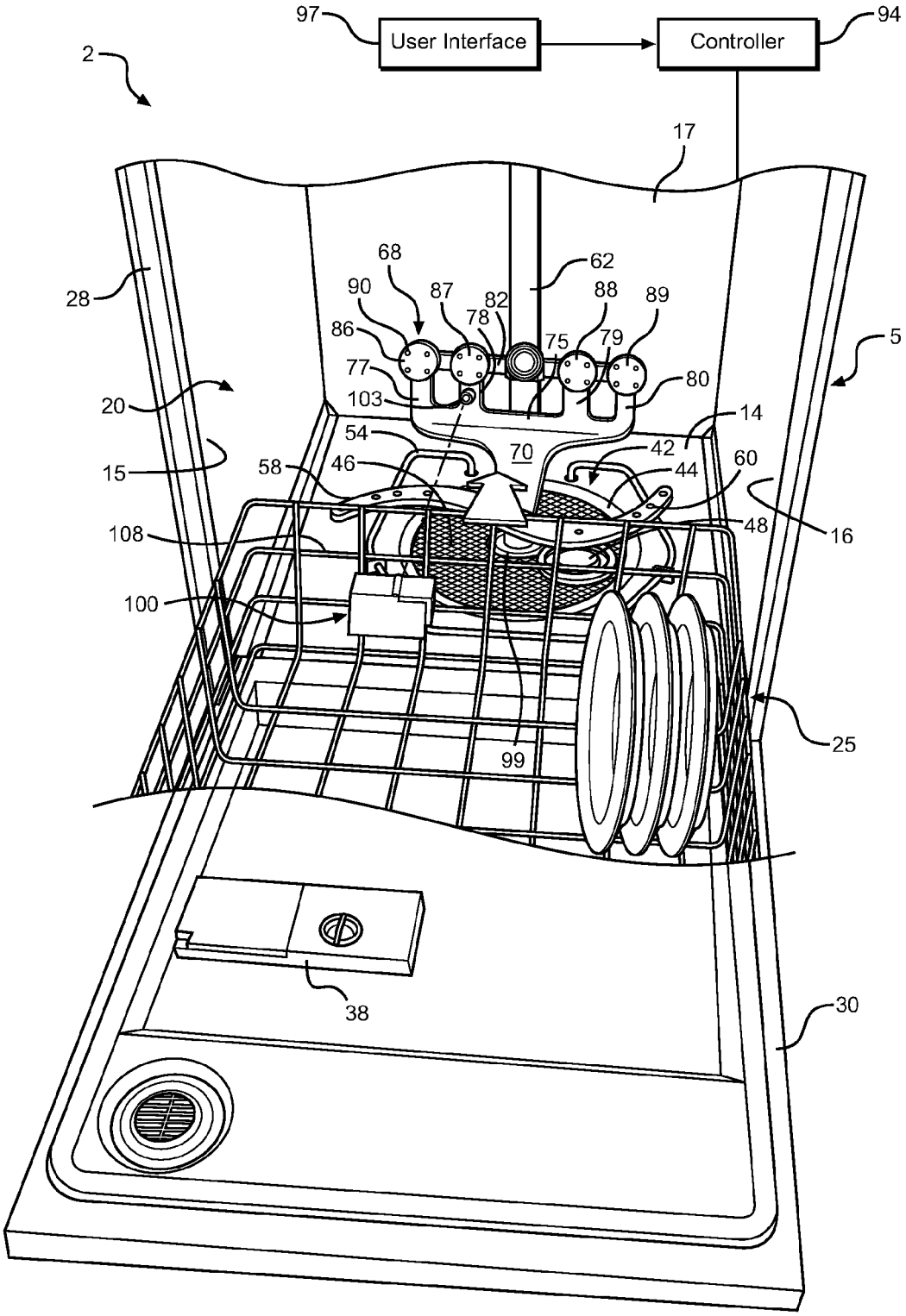
FIG. 1 is a perspective view of a dishwasher incorporating the dispensing system with timed delay in accordance with the invention.

With initial reference to FIG. 1, a dishwasher for use with the present invention is indicated at 2. As shown, dishwasher 2 includes a tub 5 which is preferably molded of plastic so as to include integral bottom, side and rear walls 14-17 respectively, as well as a top wall (not shown). At this point, it should be recognized that tub 5 could be made from various materials, including stainless steel. Within the confines of walls 14-17, tub 5 defines an interior washing chamber 20 within which soiled kitchenware is adapted to be placed, such as upon a shiftable lower rack 25 and/or an upper rack (not shown), with the kitchenware being cleaned during a washing operation. Tub 5 has attached thereto a frontal frame 28 which pivotally supports a door 30 used to seal washing chamber 20 during the washing operation. In connection with the washing operation, door 30 is preferably provided with a main detergent tray unit 38 within which a consumer can place liquid or particulate washing detergent for dispensing at a predetermined portion of the washing operation.

Disposed within washing chamber 20 is a pump and filtration assembly generally indicated at 42. In the preferred embodiment illustrated in this figure, pump and filtration assembly 42 includes a main housing 44, an annular, radially extending strainer 46 and a removable filter unit 48. Extending about a substantial portion of pump and filtration assembly 42, at a position raised above bottom wall 14, is a heating element 54. Heating element 54 preferably takes the form of a sheathed, electric resistance-type heating element. In a manner known in the art, pump and filtration assembly 42 is adapted to recirculate washing fluid to at least a lower wash arm 58 which constitutes a first spray unit having spaced nozzles 60, and a conduit 62 which leads to intermediate and upper spray arms, which constitute additional spray units (not shown), supported by the tub 25 and upper rack respectively.

Dishwasher 2, as illustrated, is also provided with an auxiliary, turbo spray or distribution unit generally indicated at 68. As is known in the art, auxiliary spray or dispensing unit 68 is operable when a user selects, or the machine automatically selects, an intensified wash cycle, as opposed to a normal wash cycle, as will be discussed further below. In any case, a main inlet conduit 70 for auxiliary spray unit 68 extends from pump and filtration assembly 42 and leads to a manifold 75. Manifold 75 redistributes washing fluid received from main inlet conduit 70 to a plurality of fluid conduits defined by arms 77-80 that are interconnected at an upper end by a cross support 82. Each arm 77-80 is adapted to direct a flow of washing fluid from manifold 75 to a respective spray head 86-89, each having various spray nozzles such as represented at 90 for spray head 86. In accordance with the arrangement shown, nozzle heads 86-89 are adapted to rotate during operation, but could actually be fixed if desired. At this point, it should be noted that the number and location of the spray heads can be readily varied in accordance with the invention. For instance, although shown extending along rear wall 17 of tub 5, the auxiliary spray unit 68 could be arranged at either or both of side walls 15 and 16.

Also associated with dishwasher 2 is a controller generally indicated at 94 in FIG. 1, as well as a user interface 97 which is actually, preferably provided on a front surface portion (not shown) of door 30. Basically, the structure of dishwasher 2 described to this point is known in the art and does not form part of the present invention such that this description is simply provided for the sake of completeness. As also widely known in the art, dishwasher 2 is adapted to perform a washing operation with a user selecting desired operation parameters through user interface 97 and also loading liquid or particulate washing detergent in detergent tray unit 38. Upon shutting door 30 to seal washing chamber 20 and initiating the start of the washing operation, controller 94 regulates the operation of pump and filtration assembly 42 and heating element 54 in order to direct heated washing fluid upon kitchenware placed on at least rack 25. More specifically, tub 5 is partially filled with washing fluid which is circulated and filtered through operation of pump and filtration assembly 42 such that washing fluid is directed to lower wash arm 58 while also being directed through conduit 62 to the upper and intermediate wash arms (not shown). The flow of washing fluid is regulated by controller 94 repositioning a flow diverter indicated at 99. In general, the function and operation of a flow diverter in the dishwasher art is known, as evidenced by the disclosure in U.S. Pat. No. 7,914,625 incorporated herein by reference. Therefore, the specific details of the operation of diverter 99 is not considered part of the present invention such that it will not be further discussed herein.

During a select portion of the washing operation, dispenser unit 38 will open in order to add detergent to the washing fluid for cleansing purposes. Also, if tough stains are expected and the user selects a tough scrubbing washing operation through user interface 97, controller 94 will position flow diverter 99, which is preferably constituted by a repositionable, sequencing valve, to direct washing fluid from pump and filtration assembly 42 into main inlet conduit 70 of auxiliary spray unit 68 during a predetermined stage of the washing operation such that the washing fluid will flow into manifold 75, arms 77-80 and out nozzle or spray heads 86-89 in order to provide a high pressure, intense washing action in at least a rear portion or intensified wash zone of rack 25.

Again, this general operation of dishwasher 2 is known in the art and the detailed description thereof is only being provided for the sake of completeness. Of particular importance in connection with the present invention is to address a desire for a higher level of detergent concentration in the washing fluid in connection with certain washing operations for dishwasher 2. Therefore, in connection with describing the timed delay of additional washing agent in accordance with the present invention, reference will be made to a desire for a higher level of detergent concentration in the washing fluid when the intense washing action is selected for dishwasher 2. More specifically, a higher level of detergent concentration in the washing fluid is desired when auxiliary spray unit 68 is employed. To this end, in accordance with a preferred embodiment of the invention, an auxiliary detergent dispenser assembly 100 is provided and adapted to receive a portion of the washing fluid delivered to spray unit 68 as will be discussed more fully below.

Figure 2:
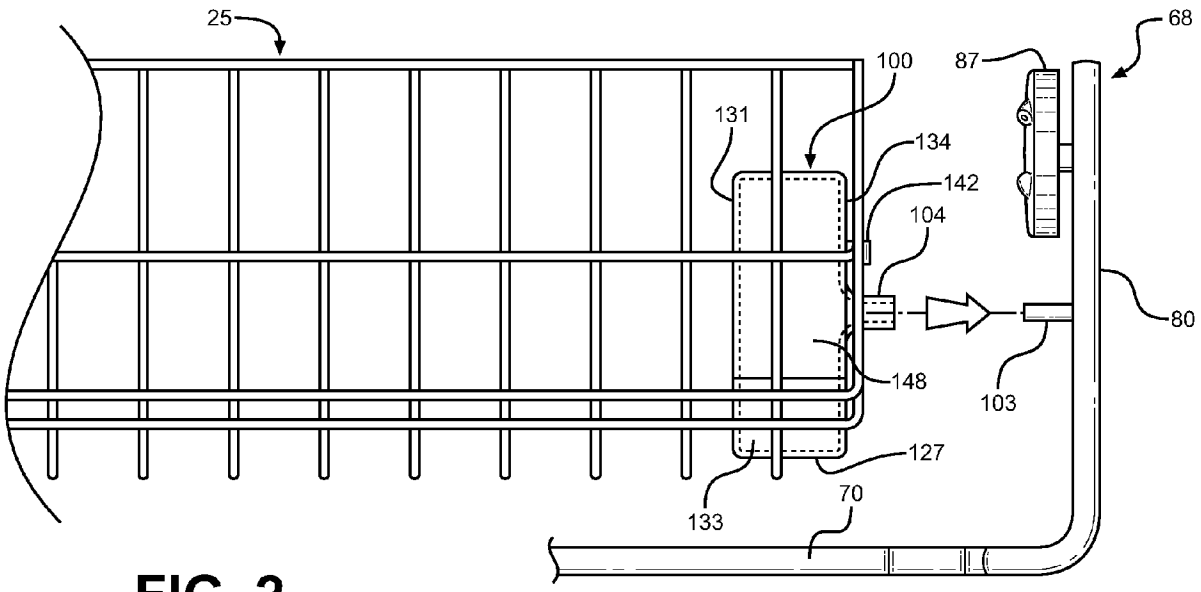
FIG. 2 is side view of the dispensing system of FIG. 1.

In the embodiment shown, an auxiliary port 103, such as in the form of a nozzle, is provided on wash arm 78, with auxiliary port 103 being upstream of nozzle head 87 and adapted to cooperate with an auxiliary detergent dispenser 100. As depicted, auxiliary detergent dispenser 100 is mounted on a back portion 108 of rack 25 so as to be attached to rack 25 for movement between a recessed position within tub 5 and an extended position at least partially outside of tub 5 as shown in FIG. 1. When dish rack 25 is moved to the recessed position, dispenser 100 is automatically arranged in fluid communication with port 103. More specifically, as shown best in FIG. 2, dispenser 100 is provided with a port attachment or receiver 104 which projects rearwardly beyond rack 25 and receives port 103 upon dish rack 25 assuming the recessed position. However, when dish rack 25 is moved to the extended position, port 103 is simply withdrawn from port attachment 104.

Figure 3:
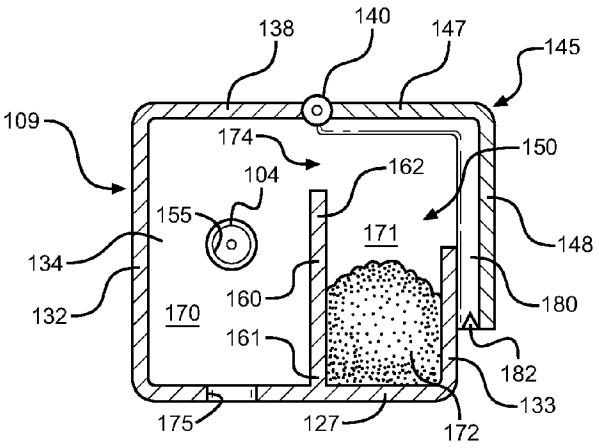
FIG. 3 is a cross-sectional view of a storage container of the dispensing system of FIGS. 1 and 2.

With particular reference to FIG. 3, the preferred construction of dispenser assembly 100 will now be described. As shown, dispenser assembly 100 includes a cup or container 109 having a base 127, front (see FIG. 2), side and rear walls 131-134, and a top 138 which terminates at a hinge 140. Arranged along rear wall 134 are a pair of spaced clip members, one of which is indicated at 142 (see FIG. 2), for snap-fittingly attaching cup 109 to rack 25. Cup 109 also includes a lid 145 having a top part 147 and a side part 148. As shown, top part 147 is pivotally mounted to top 138 through hinge 140 to provide access to an internal storage compartment 150. Provided in rear wall 134 is an inlet 155 leading into internal storage compartment 150 and defined, at least in part, by port attachment 104.

Internally, cup 109 is provided with a partition 160 having a lower end 161 joined to base 127 and an upper end 162 terminating short of top 138. Partition 160 thereby divides storage compartment 150 into a first, prefill chamber 170 and a second, additive chamber 171 containing detergent or other additive agent 172. With partition 160 terminating short of top 138, a passage or spillway zone 174 is established between prefill chamber 170 and additive chamber 171. Formed in base 127, only on the side of prefill chamber 170, is a calibrated drain hole 175, the purpose of which will become fully evident below. Finally, provided on an interior surface (not labeled) of lid 145 is one or more ribs 180 which space side part 148 from side wall 133 and establish an outlet 182 leading from storage compartment 150 on the side of additive chamber 171.

At this point, it should be recognized that, in accordance with the embodiment set forth above, it is desirable to provide for dispenser assembly 106 to be removably attached to rack 25. Certainly, this mounting objective can be performed in a variety of ways, such as snap-attaching cup 109 to rack 25 through clips 142, i.e., in a manner directly corresponding to that disclosed in U.S. patent application Ser. No. 12/959,566 entitled "Dishwasher with Auxiliary, Tough Soil Chemistry Dispensing System" and filed on Dec. 3, 2010. In any case, it should be understood that the particular manner of attachment for dispenser assembly 100 to rack 25, as well as the lateral positioning of dispenser assembly 100, can greatly vary without departing from the invention.

With this overall arrangement, additional washing detergent 172 can be readily placed within additive chamber 171 of dispenser 100 by a user, particularly when rack 25 is in the extended position of FIG. 1. That is, when rack 25 is in the extended position, lid 145 can be readily pivoted relative to the remainder of cup 109 to expose additive chamber 171 for the addition of detergent 172, which can be in particulate, tablet or even liquid form. During at least a select stage of the overall washing operation of dishwasher 2, washing fluid will be caused to flow to auxiliary spray unit 68. When this occurs, a portion of this washing fluid flow being diverted through port 103 into prefill chamber 170 through inlet 155. At the same time, drain hole 175 is exposed to tub 5 such that the washing fluid can, at least initially, simply flow out of prefill chamber 170. Actually, in accordance with the present invention, it is desired to enable all of the washing fluid entering prefill chamber 170 to exit through drain hole 175 for a certain period of time (delay period) prior to the level of washing fluid in prefill chamber 170 rising above partition 162 and flowing into additive chamber 171 through spillway 174. Once the washing fluid enters additive chamber 171, the washing fluid will mix with detergent 172 and flow through outlet 182, resulting in an increased detergent concentration for the washing operation.

This delay period depends on various factors, particularly the flow rate of washing fluid into prefill chamber 170 through inlet 155 versus the flow rate out drain hole 175. Certainly, these flow rates could be varied relative to each other in a variety of ways. For instance, knowing the flow rate through auxiliary port 103 based on the output of pump and filtration assembly 42 and the desired time required for the washing fluid level to reach spillway 174, drain hole 175 could be readily sized appropriately. In accordance with the invention, the most important factor is considered to be the desired time delay. The inclusion of this delay period is seen to be particularly important to prevent the detergent 172 in additive chamber 171 from being prematurely dispensed into tub 5. In particular, in accordance with the invention, it is only desired to add detergent 172 from additive chamber 171 into washing chamber 20 to create an intensified wash zone during a certain stage of a tough soil washing operation selected through user interface 97. However, due to the operation of flow diverter 99, washing fluid may actually be delivered to auxiliary spray unit 68 at multiple times during the overall washing operation. For instance, when transitioning between washing fluid being directed to lower spray arm 58 and then to conduit 62 for the upper and intermediate spray arms, flow diverter 99 actually shifts through a position wherein washing fluid is temporarily directed to main inlet conduit 70 for auxiliary spray unit 68. In a current dishwasher model, this transition period can last in the range of 7-15 seconds. Throughout this time frame, a percentage of the washing fluid directed to auxiliary spray unit 68 will flow to inlet 155, but it is not desired to permit this washing fluid to pick up the additional detergent 172. However, with the establishment of multiple chambers within cup 109 and the inclusion of calibrated drain hole 175, the washing fluid is prevented from reaching additive chamber 171. On the other hand, when it is desired to activate auxiliary spray unit 68, flow diverter 99 is positioned to provide a prolonged flow of washing fluid through main inlet conduit 70, resulting in washing fluid filling prefill chamber 170, reaching spillway 174, entering additive chamber 171, mixing with detergent 172 and exiting outlet 182. Again, by picking up the additional detergent, this washing fluid will have an increased detergent concentration to aid in creating an intensified wash zone in washing chamber 20 during at least one stage of the overall washing operation so as to provide an enhanced washing operation for tough soiled kitchenware arranged in lower rack 25.

Based on the above, it should be readily apparent that the objects of the invention can be carried out in various different ways. For instance, instead of dispenser assembly 100 being attached to rack 25 for movement relative to tub 5, dispenser assembly 100 could be fixed to auxiliary spray unit 68. In addition, the particular manner in which dispenser assembly 100 both receives and releases the washing fluid can vary in accordance with the invention. For instance, instead of providing auxiliary port 103, prefill chamber 170 could receive a flow of fluid directly from one of spray heads 86-89, such as by enlarging inlet 155 and repositioning cup 109 to be aligned with the selected spray head. Such an arrangement could be particularly advantageous in connection with providing a retrofit for an existing dishwasher model. In any case, it should also be readily apparent that a significant aspect of the invention concerns dispensing detergent when a flow of washing fluid is received from a select source, here the auxiliary spray unit 68 rather than the lower arm 58 or the other washer arm, for a predetermined minimum amount of time. In fact, it should be apparent that inlet 155 to cup 109 is blocked from receiving flow from the other spray units.

Although described with reference to preferred embodiments of the invention, it should be readily understood that various changes and/or modifications can be made to the invention without departing from the spirit thereof. Instead, it should be perfectly clear that the present invention provides for a partitioned auxiliary dispenser to be conveniently attached within a dishwasher washing chamber for the delivery of supplemental detergent or other washing agent in a timed delay fashion during a washing operation. In general, the invention is only intended to be limited by the scope of the following claims.

What is claimed is:

1. A dishwasher comprising:

a tub including a washing chamber;

a dish rack adapted to support kitchenware to be washed in the washing chamber;

a first spray unit mounted within the tub for spraying washing fluid toward the dish rack during at least a first stage of a washing operation;

a second spray unit mounted within the tub for spraying washing fluid toward the dish rack during at least a second stage of the washing operation;

a pump and filtration assembly for sequentially delivering washing fluid to at least the first and second spray units during the washing operation; and a dispenser assembly including:

a container internally partitioned to define a prefill chamber, an additive chamber for housing a washing agent, and a passage fluidly communicating the prefill chamber with the additive chamber, the container including a base, side, rear and top walls, and a partition wall extending within the container from the base toward the top wall, said partition wall establishing the passage;

an inlet allowing for washing fluid to enter the container, said inlet leading into the prefill chamber;

a calibrated drain hole exposed to the prefill chamber of the container; and an outlet exposed to the additive chamber, wherein washing fluid entering the inlet during the washing operation can only flow into the additive chamber through the passage in order to pick up washing agent from the additive chamber after substantially filling the prefill chamber having the drain hole.

2. The dishwasher of claim 1, wherein the first spray unit is constituted by a spray arm rotatably mounted within the tub and the second spray unit includes a plurality of spray heads arranged at spaced locations on a wall of the tub, said second spray unit being configured to create an intensified wash zone in the washing chamber during the second stage of the washing operation.

3. The dishwasher of claim 2, further comprising: an auxiliary port extending from the second spray unit and being adapted to register with the inlet of the dispenser assembly.

4. The dishwasher of claim 3, wherein the rack is mounted for movement between a recessed position within the tub and an extended position at least partially outside of the tub, said dispenser assembly being mounted to the rack for concurrent movement between the recessed and extended positions, with the inlet automatically registering with the auxiliary port upon shifting of the rack to the recessed position.

5. The dishwasher of claim 1, wherein the dispenser assembly further includes a lid pivotally mounted through a hinge for selectively exposing the additive chamber.

6. The dishwasher of claim 1, wherein the dispenser assembly is mounted to the rack for concurrent movement between recessed and extended positions.

7. The dishwasher of claim 1, wherein the partition wall is spaced from the top wall by the passage which defines a spillway leading to the additive chamber.

8. The dishwasher of claim 7, wherein the partition wall includes an upper end which is arranged above a level of the inlet, said drain hole being provided below the level of the inlet.

9. The dishwasher of claim 8, wherein the drain hole is formed in the base.

10. The dishwasher of claim 1, further comprising:

a door mounted for movement between an open position for accessing the washing chamber and a closed position sealing the washing chamber for the washing operation; and a primary washing agent dispenser provided on the door.

11. The dishwasher of claim 1, wherein the inlet is positioned relative to the additive chamber such that washing fluid entering the container flows only directly into the prefill chamber.

12. The dishwasher of claim 1, wherein the additive chamber is positioned between the prefill chamber and the outlet.

13. A dispenser assembly for use in a dishwasher comprising:

a container internally partitioned to define a prefill chamber, an additive chamber for housing a washing agent, and a passage fluidly communicating the prefill chamber with the additive chamber, the container including a base, side, rear and top walls, and a partition wall extending within the container from the base toward the top wall, said partition wall establishing the passage;

at least one attachment member extending from the container and configured to attach the container to a rack of a dishwasher;

an inlet allowing for washing fluid to enter the container, said inlet leading into the prefill chamber;

a calibrated drain hole exposed to the prefill chamber of the container; and an outlet exposed to the additive chamber, wherein the container, the inlet, the drain hole and the outlet are configured such that, when the container is arranged in a dishwasher for a washing operation, washing fluid entering the inlet during the washing operation can only flow into the additive chamber in order to pick up washing agent from the additive chamber after substantially filling the prefill chamber having the drain hole.

14. The dispenser assembly of claim 13, wherein the partition wall is spaced from the top wall by the passage which defines a spillway leading to the additive chamber.

15. The dispenser assembly of claim 14, wherein the partition wall includes an upper end which is arranged above a level of the inlet, said drain hole being provided below the level of the inlet.

16. The dispenser assembly of claim 15, wherein the drain hole is formed in the base.

17. The dispenser assembly of claim 14, further comprising: a lid pivotally mounted through a hinge for selectively exposing the additive chamber.

18. The dispenser assembly of claim 17, wherein the outlet is defined between the container and the lid.

19. The dispenser assembly of claim 13, wherein the inlet is positioned relative to the additive chamber such that washing fluid entering the container flows only directly into the prefill chamber.

20. The dispenser assembly of claim 13, wherein the additive chamber is positioned between the prefill chamber and the outlet.

* * * * *